United States Patent [19]

Donlon et al.

[11] 4,213,204

[45] Jul. 22, 1980

[54] RESCUE VEST FOR NEW-BORN BABIES

[76] Inventors: Frances M. Donlon, 9200 Peabody St.; Jerry H. Van Buskirk, 8015 Urbanna Rd., both of Manassas, Va. 22110

[21] Appl. No.: 59,491

[22] Filed: Jul. 23, 1979

[51] Int. Cl.[2] ..... A41D 1/00; A41D 1/04

[52] U.S. Cl. ..... 2/94; 2/102

[58] Field of Search ..... 2/94, 102, 69, 48, 44, 2/45; 150/2; 224/5 T, 6

[56] References Cited

U.S. PATENT DOCUMENTS

| | | | |
|---|---|---|---|
| 3,601,815 | 8/1971 | Strehlan | 2/48 |
| 3,841,543 | 10/1974 | Bolton | 224/6 |
| 4,079,467 | 3/1978 | Baldwin | 2/94 |

*Primary Examiner*—Doris L. Troutman

[57] ABSTRACT

A wrap-around garment in the form of a vest which may be readily donned to provide safe and secure protection for a plurality of new-born babies during hasty and rapid evacuation from the nursery of a hospital or similar institution in the event of an emergency, such as fire, by nurses or other personnel, the vest comprising a pair of just above knee-length spaced panels, joined at the upper back edges by a plurality of straps attached thereto, the adjacent edges of the panels being so spaced as to provide sufficient flexibility to adapt the garment to fit adults of varying size and stature, each panel having an opening in the upper portion thereof to receive an arm of the wearer, leaving the arms free for other duties. Straps are attached to the front leading edge of one of the panels and means are provided for temporarily securing the ends of the straps to the other panel to maintain the garment securely in position on the body of the wearer, each panel having attached thereto at a point below the base of the armhole to insure proper balance, an elongated pocket of ample dimensions to accommodate at least two new-born babies wrapped in crib blankets, the pockets being located towards the rear of the panels and above the knees of the wearer to afford safe and secure protection for the babies during hasty evacuation.

3 Claims, 4 Drawing Figures

RESCUE VEST FOR NEW-BORN BABIES

BACKGROUND OF THE INVENTION

This invention relates to a wrap-around garment in the form of a vest which may be easily and rapidly donned and effectively secured to the body of the wearer to provide safe and secure protection for new-born babies during hasty and forced evacuation from a nursery in hospitals and comparable institutions in the event of fire or other emergencies.

Very little attention seems to have been paid to this important problem although safe and rapid removal of the new-born from institutions of the type in question should be a matter of prime importance to administrators and all personnel concerned with infant care. Nurseries are frequently located on an upper floor of such buildings and this presents additional problems in establishing effective procedures for orderly evacuation to be followed if and when such occasions arise.

While every precaution is taken in hospitals and the like to prevent accidents, such as fire, such events do happen and it is essential that personnel not only be trained to cope with such problems but that they be provided with simple and effective means to insure that the new-born be evacuated with a minimum of discomfort to a place of safety.

In the event of fire, elevators, as a matter of precaution, are generally rendered inoperative, and personnel are forced to rely on fire-escapes, stairways, and emergency exits to leave the building. Smoke and fumes are factors that must be reckoned with and may pose a major problem. Personnel may be forced, in extreme cases, to keep close to the floor where the air is usually clearer and may have to literally crawl on their hands and knees to reach a usable exit. Obviously, it is important that any means provided to assist in the rescue operation leave the arms of the presonnel involved free and unencumbered for other duties during their hasty departure from the building.

In order to overcome, as far as possible, the above described difficulties encountered in such rescue operations, we have devised a simple wrap-around garment in the form of a vest which may be rapidly donned by hospital personnel to evacuate a plurality of new-born babies in an expedient and safe manner, the garment being described in detail in the accompanying specification and drawings.

THE PRIOR ART

The prior art is replete with coats and vests having pockets adapted to hold a variety of objects ranging from nails and other small hardware to bagged game. This includes aprons to be worn by carpenters or by the housewife for use around the house or garden, and coats for use by hunters, the pockets being primarily designed to hold game bagged during the days hunt. Such garments are ill-designed and impractical for use in assisting in the rescue of new-born infants in emergency situations.

Protecting infants in rescue operations where human lives are involved, requires a different approach from that suggested by the type of prior art illustrated in the above examples. In the use of applicants' invention, time is of the essence, a factor of no or little importance in the use of the garments shown in the prior art. This is likewise true with respect to the other features of applicants' design, namely, means to afford protection to new-born babies in time of extreme danger. No prior art seems to be addressed to the problems confronting the applicants and hence no suggestions appear therein as to the features or modifications necessary to arive at the novel and simple garment devised by the present inventors.

BRIEF DESCRIPTION OF THE INVENTION

The present invention relates, in general, to a wrap-around garment in the form of a vest which may be readily donned, as well as removed, to provide safe and secure protection to a plurality of new-born babies during evacuation from the nursery of a hospital or like institution in the event of an emergency, such as fire.

The garment, of novel design, comprises a pair of substantially symmetrical above knee length panels joined at their upper back inwardly extending edges by a plurality of straps of such length as to leave a substantial distance between the two panels. This spacing affords considerable flexibility so that the garment can be readily adjusted to fit adults of varying size and stature. Armholes are provided near the upper end of each panel in the approximate center thereof to receive the arms of the wearer. Attached to the upper leading front edge of one of the panels are a series of straps, and means are provided at corresponding opposite points on the other panel for securing the free ends of the straps threrto to securely maintain the garment in position on the wearer. The straps are preferably of a pressure adhering but readily strippable type of fabric available in the market under the trade name VELCRO. The straps may be entirely of this type of fastener or a short section may be affixed near the end of the inner surface thereof and the opposing strip fastened opposite thereto on the other panel. Other fastening means may be employed, if desired, such as buckles or rings.

Attached securely to the lower portion of each panel are pockets open at the upper end of sufficient dimensions to accommodate at least two new-born babies in their crib blankets, the bottom of the pockets being so located as to avoid any bumping of the babies by the knees of the wearer. The pockets are so positioned on the panels to provide proper balance when the garment is used in the manner described, the design of the garment leaving the arms of the wearer free and unencumbered for other duties in the event of a hasty and forced evacuation during an emergency.

The herein described garment is preferably made of a durable fabric, such as canvas or duck, will be readily stored and laundered, and may be brightly colored to rapidly distinguish to from other hospital garments. The fabric may be flame-proofed for an added degree of protection, if desired.

DETAILED DESCRIPTION OF THE INVENTION

Figure 1:
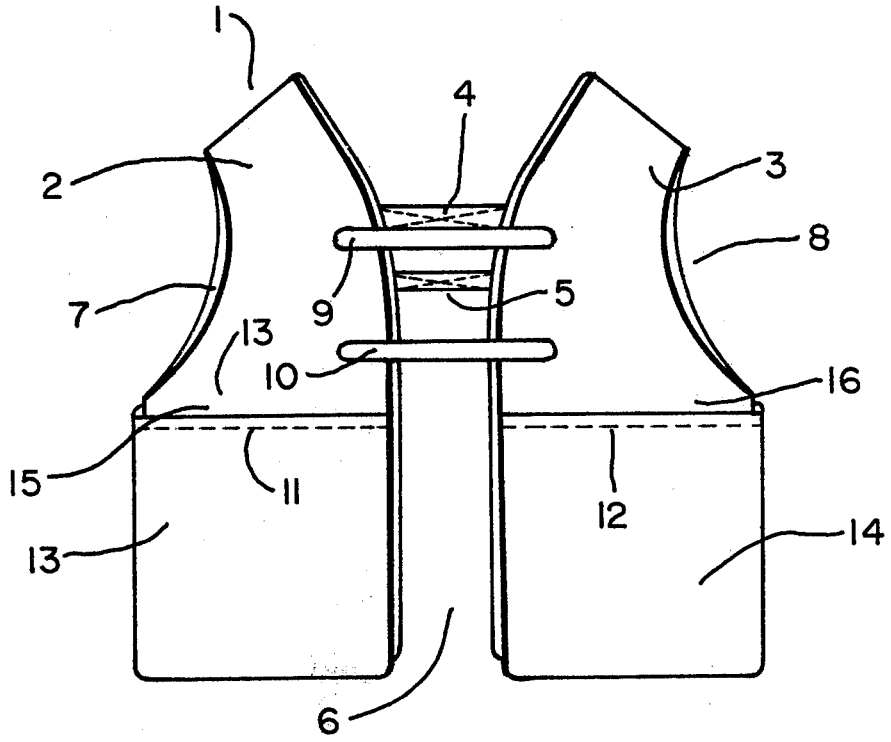
FIG. 1 is a front view of the complete garment showing the front straps for securing the garment on the body of the wearer.

Our invention relates, as depicted in the accompanying drawings, to a wrap-around garment in the form of a vest which may be easily and rapidly donned to provide safe and secure protection for a plurality of new-born babies during hasty evacuation from a hospital or like institution in the event of a fire or other emergency.

The garment, designated generally in the drawing by the numeral "1," comprises a pair of fabric panels, "2," and "3," of substantially the same configuration and size, are joined at their upper back leading edges by fabric strips, "4," and "5," of sufficient length to leave a space "6," therebetween. This imparts considerable flexibility to the garment so that it is readily adjustable to fit adults of different sizes and stature. Attached to the upper front portion of panel "2," are a plurality of straps, "9," and "10," preferably of a pressure adhering but readily strippable type of fabric available on the market under the trade name VELCRO. The straps "9," and "10," may be entirely of this type of fabric or a short section of the same may be affixed near the ends of the inner surfaces thereof and the opposing strips fastened opposite thereto on the face of opposite panel. It is evident that other types of fastening means, such as buckles or rings may be used for this purpose, if desired.

Armholes, "7," and "8," located near the upper mid-section of the panels, "2," and "3," provided to receive the arms of the wearer so that the arms and hands will be free and unencumbered for other duties during an emergency.

Figure 2:
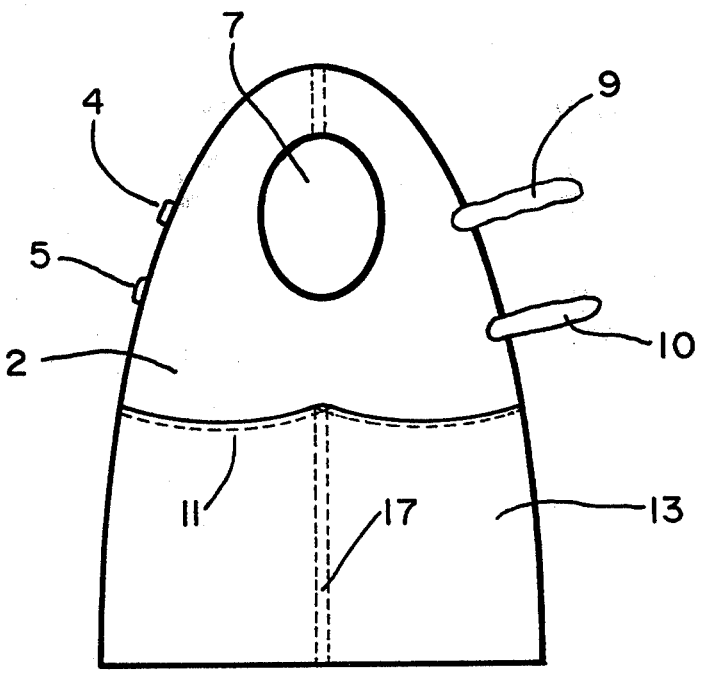
FIG. 2 is a side view of the garment.

Attached by appropriate stitching, "11," and "12," to the lower portion of panels, "2," and "3," and centered directly below armholes, "7," and "8," are oppositely disposed pockets, "13," and "14," open at the upper ends, "15," and "16," respectively, of sufficient dimensions to accommodate at least two new-born babies in their crib blankets. As illustrated in FIG. 2 of the drawing, the pockets may be divided by a central seam "17," into two compartments, each of sufficient size to receive a new-born infant.

The bottom of the garment terminates at a point slightly above the knees of an average adult to insure that the pockets will not be bumped by the knees, particularly if the wearer, as previously noted, may find it necessary to crawl on hands and knees to the nearest usable exit. The pockets are so located as to evenly distribute the load and provide proper balance and comfort of the wearer.

Figure 4:
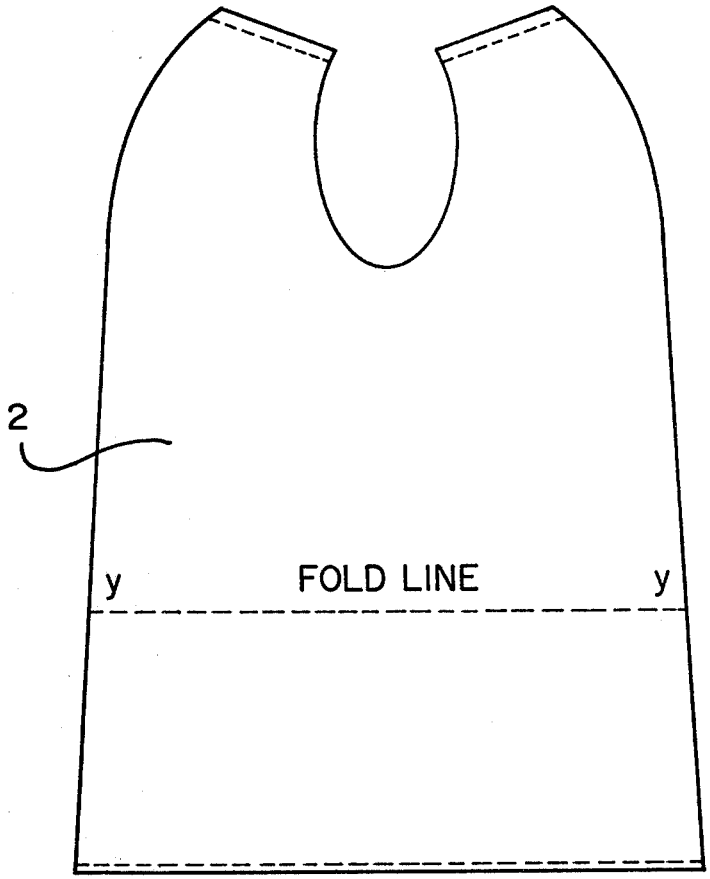
FIG. 4 is a plan view of a pattern which may be used in making each of the two panels constituting the complete garment.
Figure 3:
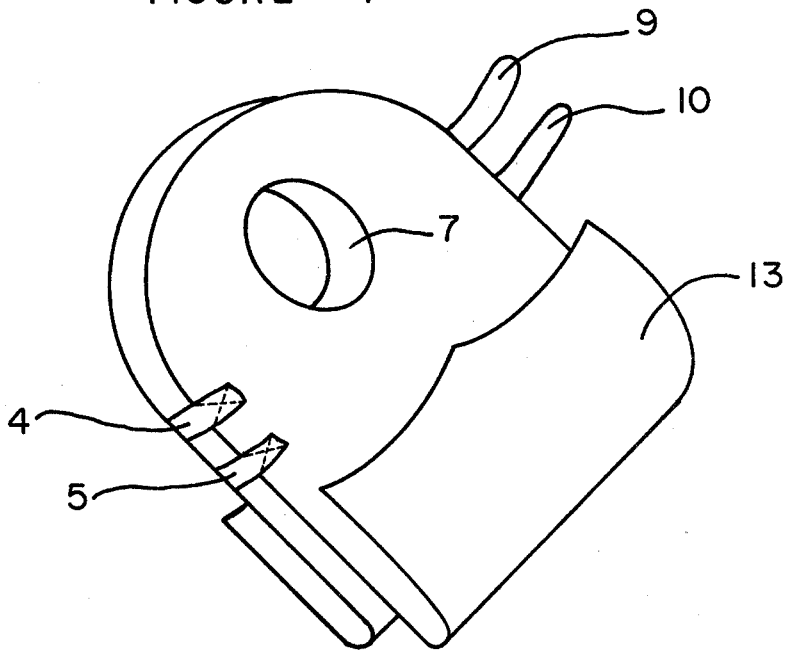
FIG. 3 is a perspective view of the garment.

A pattern, as shown in FIG. 4, may be used in preparing the panels, "2," and "3," which are of substantially the same size and dimensions, preferably of canvas or duck fabric. The upper edges of each panel are stitched together to form the armholes, "7," and "8," and in order to save fabric and facilitate assembly, the panels may be made of sufficient length as to folded along the line y—y, as illustrated in FIG. 3, and stitched or otherwise fastened along the leading edges to form the pockets, "13," and "14."

Conventional sewing procedures may be used in fabricating the garment, and to improve the appearance, the edges may be bound with a polyester knit seam binding, which may be of a different color from that of the two panels. This results in an attractive, sturdy garment, long-wearing, easily laundered and stored and readily distinguishable from other hospital equipment. Moreover, it will afford a basis for the establishment of an organized, safe and effective evacuation procedure of new-born babies from hospitals and other institutions in case of emergency.

Our invention has been described with reference to a preferred embodiment thereof, but it will be understood that changes, obvious to those skilled in the art, may be made within the scope and spirit of the appended claims.

We claim:

1. A wrap-around garment in the form of a vest which may be readily donned to provide safe and secure protection during rapid evacuation of a plurality of new-born babies from a nursery in the event of an emergency, such as fire, comprising;

a pair of above knee length spaced unitary panels, joined at the upper back, inwardly extending edges thereof, by a plurality of fabric straps attached thereto, and defining a space between the two panels, to adapt the garment to fit adults of varying size and stature, each panel having on its upper mid-section an opening to receive an arm of the wearer, thereby leaving the arms of the wearer free and unencumbered for other duties, a plurality of fabric straps attached to the front upper leading edge of one of the panels, the opposite panel having fastening means on its upper front leading edge to temporarily but firmly secure said straps to maintain the garment in position on the wearer, and, each panel having secured by stitching at a point below the base of the armhole, an elongated fabric pocket, open at the upper end, and of a size sufficient to accommodate at least two new-born babies wrapped in crib blankets, the pockets being so located on the panels as to afford proper balance and weight distribution, and to insure safe handling of the babies without bumping by the knees of the wearer during hasty evacuation.

2. A garment as defined in claim 1, in which the straps for securing the garment about the body of the wearer, are of a pressure-sensitive but readily strippable fabric, to afford easy removal of the garment after use.

3. A garment as defined in claim 1, in which the fabric panels are of sufficient length to be folded back and fastened in place to form the pockets adapted to receive the new-born babies.

* * * * *